United States Patent [19]

Jensen

[11] Patent Number: 4,733,780

[45] Date of Patent: Mar. 29, 1988

[54] BLOCK-SEALED FLEXIBLE SADDLE BAGS

[76] Inventor: Harold A. Jensen, 31 Annadea Rd., Brockton, Mass. 02402

[21] Appl. No.: 70,901

[22] Filed: Jul. 8, 1987

[51] Int. Cl.[4] ..... B65D 30/20; B65D 33/00

[52] U.S. Cl. ..... 206/554; 383/9; 383/32

[58] Field of Search ..... 206/554; 383/37, 38, 383/9, 7, 26, 25, 32

[56] References Cited

U.S. PATENT DOCUMENTS 3,352,411 11/1967 Schwarzkopf ..... 206/554
3,718,253 2/1973 Smith ..... 206/554
4,125,220 11/1978 Suominen ..... 383/9
4,560,068 12/1985 Membrino ..... 206/554
4,669,251 6/1987 Inagaki ..... 383/9

FOREIGN PATENT DOCUMENTS 2408831 8/1975 Fed. Rep. of Germany ..... 206/554

*Primary Examiner*—Willis Little
*Attorney, Agent, or Firm*—Samuels, Gauthier, Stevens & Kehoe

[57] ABSTRACT

A block of paired, side-gussetted, bottom-weld bags. Each bag has an opening on one side to facilitate the removal of individual bags from the block.

10 Claims, 7 Drawing Figures

BLOCK-SEALED FLEXIBLE SADDLE BAGS

BACKGROUND AND BRIEF SUMMARY OF THE INVENTION

This invention relates to the field of flexible packaging and more particularly to paired saddle bags, each bag having an aperture formed in one side thereof to facilitate removal of a bag from a stack and to the method of forming such bags.

In flexible packaging there are different types of bags formed. There are side weld bags formed by joining ribbonlike films together and sealing the seams. There are bottom weld bags formed by extruding a tubular film and forming a seam along the bottom of the bag. In bottom weld bags the film in flat two-ply form is sealed along one line at a first location to form the bottom of one bag; and perforated or cut along a second line parallel to the first line, to form the top of the next bag.

There are bags formed in pairs with their upper edges being joined. These paired bags are hung on a support in saddle-like fashion. These bags whether formed as bottom-weld, side-gussetted bags or side-weld bags, are stacked and block sealed for ease of handling. Anywhere from twenty-five (25) to fifty (50) bags may be stacked and sealed at the same time or the bags may be stacked and sealed sequentially to form a bundle of block sealed bags. The bags are typically sealed one to the other along an edge, usually their upper edges. Below these sealed upper edges are the perforated lines which allows an individual bag to be removed from the bundle. Generally, the seal will be from a fraction of an inch to an inch or more in width. One or more holes may be punched through the block seal in order that the bags may be carried by a dispenser.

When a bag is removed from a block it has a tendency to cling to the bag it contacts such that the removal of one bag from another is hindered. In some uses of such bags, such as in deli counters, checkout registers etc., there is time wasted in separating the bags and subsequently opening the bags which results in frustration and on occasion the bags are discarded because they do not open easily.

These difficulties have been overcome by the inventions of the inventor with the bags and method of making the bags as set forth in my U.S. Pat. No. 4,559,119 and my copending application Ser. No. 879,899 filed June 30, 1986, both of which are hereby incorporated by reference in their entireties into this disclosure.

In this disclosure the inventive aspects of those disclosures are applied in a unique way to block-sealed paired bags. Each bag may be removed simply by passing a finger through an opening, grabbing a side and pulling outwardly. The user of the bags would necessarily apply tension to the bag and it would separate from the other bags to which it is joined at a perforated line as well as separate one side of the bag from the other; i.e. open the bag.

The present invention is in one aspect an improvement of the method of making the side-gussetted, bottom-weld bags such as described in my aforementioned patent or application. More particularly the present invention embodies a method of forming paired bags and the bags formed by such method. One side of each of said bags has an opening formed therein. The use of the term "opening" as used in this disclosure is intended to mean an opening in one ply of the bag such as a circle, square, ellipse or the like formed below the upper edge of the side, or that the opening intersects the upper edge of one side of the bag and/or the opening extends from one side to the other side of the bag. First and second paired bags are joined to one another at their upper edges along a common release line. Each bag has an outer wall and a facing wall. An opening is formed in the outer walls and the release line intersects the aperature. A retention portion is integrally formed at the release line. The retention portion releasably joins a plurality of paried bags in a stacked configuration.

DESCRIPTION OF THE PREFERRED EMBODIMENT(S)

The invention will be described in reference to block-sealed, side-gussetted, bottom-weld bags. The techniques for forming these bags per se from continuous film are well known in the art and need not be described in detail.

As set forth in my aforementioend disclosures, upstream of the station where the bags are sealed and cut to size, vacuum plates in spaced apart relationship are secured above and below the travelling film. Preferably the film travels on or is adjacent to the bottom vacuum plate.

Figure 1:
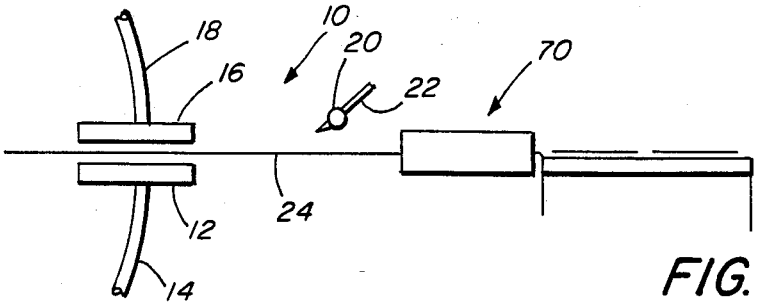
FIG. 1 is a side schematic view of an apparatus for forming bags embodying the invention.
Figure 2:
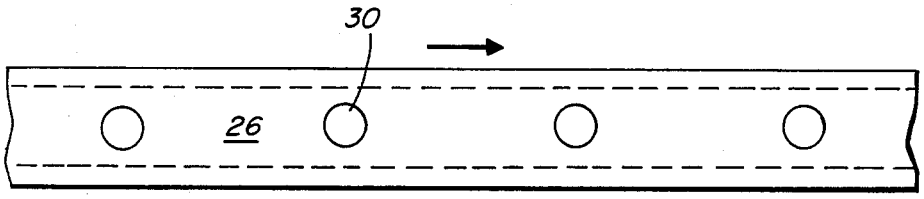
FIG. 2 is a plan view of a flattened tubular film having an opening formed in one side thereof.

Referring to FIGS. 1 and 2, an apparatus is shown generally at 10 and comprises a bottom vacuum plate 12 having a plurality of perforations (not shown) therein. A vacuum line 14 creates the vacuum within the plate.

Above vacuum plate 12 is a vacuum plate 16 having plurality of perforations (not shown) and a vacuum line 18 to create the vacuum in the plate 16. Additionally, recessed in the plate 16 is a dieholder to which is secured a circular die. The dieholder is a solid rectangular ceramic block. The die which determines the shape of the opening formed, extends from the block; and is connected to two leads which in turn are connected to a suitable source of current. Downstream of the vacuum plates is a nozzle 20 joined to a compressed air line 22. Passing between the plates is a side-gussetted, two-ply film 24 comprising upper ply 26 and lower ply 28 and an opening 30.

The preferred embodiment will be described in regard to the following as a non-limiting example. High density polyethylene film, two-ply, one mil thick formed as a continuous tube is flattened and passes through the vacuum plates 12 and 16. Initially, the opening shown at 30 is made manually in the upper ply. When the opening reaches the nozzle 20 the film expands or billows as shown in FIG. 1. The vacuum on vacuum plate 16 is between 22–25 inches. The vacuum on vacuum plate 12 is about 10 inches. These vacuums are preferably applied continuously. When the film billows it contacts the die, and at the same time the vacuum applied to line is increased to approximately 29 inches. The ply of film which contacts the die is cut as a circle which is removed (as in the case in the preferred embodiment of my patent) by being withdrawn through the vacuum line 28 and discharged into a hopper.

After the cut has been made, the increased vacuum in line 18 ceases. The film moves in the direction of the arrow. The top ply settles and the film resumes its travel until the opening just formed is contacted by the air jet from line 20. The film inflates and the cutting operation is performed. These steps continue in timed sequence to form the spaced openings in one ply on the side of the film as shown in FIG. 2.

Referring to FIG. 1, a cutting and sealing station is shown schematically at 70. At this station the film is sealed, cut and perforated in timed sequence with the movement of the film to form the bags shown in detail in FIG. 3. The equipment and techniques for sealing, cutting and perforating are known in the art and need not be described in detail.

Figure 3:
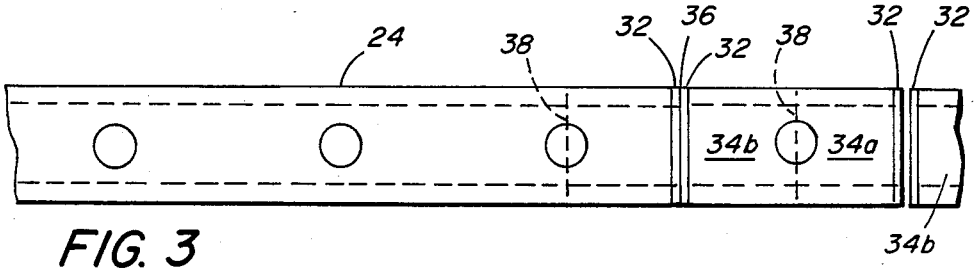
FIG. 3 is a plan view of the film of FIG. 2, a portion having been formed into bags.

Referring to FIG. 3, the continuous film 24 is sealed along seal line 32 to form the bottom of a bag **34*b*, of paired bags 34*a*–34*b*, and cut along a line 36 to separate the pair bags 34*a*–34*b* from the film 24. Also when the seal 32 is formed, a perforated release line 38** is formed in parallel, spaced-apart relationship in both plies (sides of the bag) of the film.

Depending upon the specific film, the size of the cut and other operating conditions the process can be run continuously or continually; that is, in the latter instance the film can be stopped for a fraction of a second after inflating to allow for the cutting and removal of the blank.

After the bags have been formed (FIG. 3) they are stacked, one on top of the other, with the edges aligned, at anywhere between twenty-five (25) to fifty (50) bags in a bundle. The number of bags to be stacked will depend upon the type of block seal made, the film thickness and the ultimate use of the block-sealed bundle.

Figure 4:
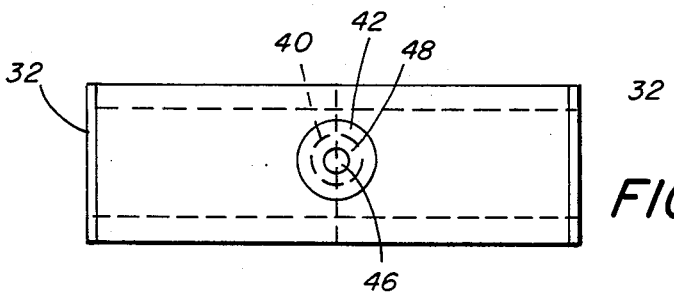
FIG. 4 is a plan view of the stacked bags of FIG. 3 block-sealed with a ring seal.

As shown in FIG. 4, a ring-like seal 40 is formed in the facing sides 42 of the bags within the opening 30. This seal joins the bags one to the other and forms a bundle 44. The seal(s) is characterized by a hole 46 in the center and a perforated outer circumference 48. The circumference 48 is joined with the perforated line 38 formed in the facing side 42.

Figure 5:
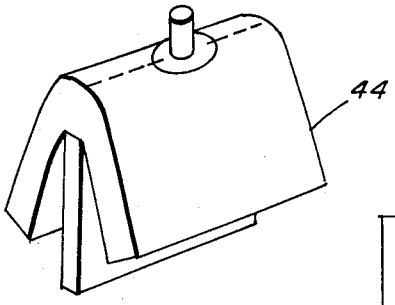
FIG. 5 is a perspective view of the bags of FIG. 4 on a dispenser.
Figure 6:
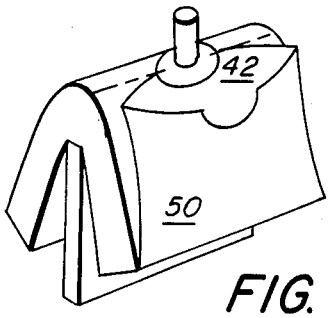
FIG. 6 is a perspective view of a bag being removed.

Referring to FIGS. 5 and 6, when a bag is removed the outer side 50 is pulled from the bundle, the perforated line 38 and circumference 48 allow the bag to be removed, the bundle and seal staying with the dispenser.

Figure 7:
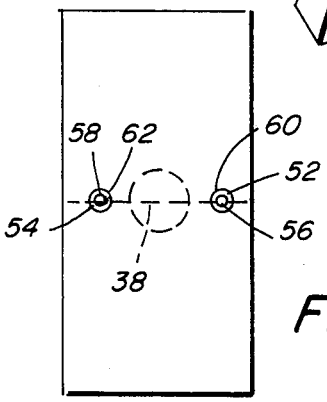
FIG. 7 is a plan view of stacked bags of an alternative embodiment.

In FIG. 7, alternative embodiment is shown where ring seals 52 and 54 are formed with holes 56 and 58, the seals having perforated outer circumferences 60 and 62 joined to a release line 38. The seals join both sides of each of the bags one to the other to form the block.

The invention has been described in reference to the forming of an opening in one side of a two-ply tubular film. Obviously different geometric shapes of blanks cut. Also if desired the portion to be removed could be simply perforated such as by using a serrated die and the blank removed later. Additionally different blanks could be removed from both sides of the two-ply film; that it, dies could be placed within both vacuum plates and either vacuum plate may contain one or more dies. The film used in the invention could be any film such as is currently experienced in flexible film packaging such as any of the polyethylenes etc. Further other materials of constructions can be used for the die.

Having described my invention, what I now claim is:

1. Paired flexible bags which comprise:

a first seamless side-gussetted bag joined to a second seamless side-gussetted bag at their upper edges along a common release line, each bag having an outer wall and a facing wall;

a common aperture formed only in the outer walls, the aperture intersected by the release line;

a suspension portion integrally formed at the release line, the suspension portion characterized by a hole formed in said facing walls and the bags being releasably secured to said suspension portion.

2. The bags of claim 1 wherein the suspension portion is formed within the perimeter of the aperture.

3. The bags of claim 2 wherein the aperture is circular.

4. The bags of claim 1 which include a plurality of said bags in stacked relationship and sealed to one another at the suspension portion.

5. The bags of claim 1 wherein the suspension portion comprises two holes formed in the release line on either side of the aperture, the hole surrounded by a ring-like seal.

6. The bags of claim 5 which includes a plurality of bags in stacked relationship and joined to one another by the ring-like seals.

7. A method for forming flexible bags which includes:

introducing a film in flat configuration between two vacuum plates spaced apart from one another;

inflating the film to billow the same by introducing an airstream into the film downstream of said plates such that the one ply of the film contacts the other vacuum plate, the other vacuum plate having a die; the other ply drawn into engagement with the die, said other ply cut substantially simultaneously upon contacting the die thereby forming an opening;

deflating the film whereby it resumes its flat configuration;

cutting the film from one side to the other;

sealing the cut film at either end thereof to form seal lines;

forming a perforated line intermedate the sealed ends and intersecting the opening; and forming a suspension portion in the bags integraly with the peforated line whereby the bags may be removed from the suspension portion.

8. The method of claim 7 which includes:

placing the bags in a stacked configuration; and forming a seal between the bags.

9. The method of claim 8 wherein the suspension portion is a ring-like seal formed within the perimeter of the opening.

10. The method of claim 9 which includes:

forming two ring seals along the perforated line.

* * * * *